US011808480B2

(12) United States Patent
Nakaya et al.

(10) Patent No.: US 11,808,480 B2
(45) Date of Patent: Nov. 7, 2023

(54) DECORATIVE PANEL AND INDOOR UNIT

(71) Applicant: Mitsubishi Electric Corporation, Tokyo (JP)

(72) Inventors: Yoshie Nakaya, Tokyo (JP); Tatsuo Furuta, Tokyo (JP); Keisuke Tomomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 456 days.

(21) Appl. No.: 17/279,150

(22) PCT Filed: Nov. 28, 2018

(86) PCT No.: PCT/JP2018/043726
§ 371 (c)(1),
(2) Date: Mar. 24, 2021

(87) PCT Pub. No.: WO2020/110219
PCT Pub. Date: Jun. 4, 2020

(65) Prior Publication Data
US 2021/0389018 A1 Dec. 16, 2021

(51) Int. Cl.
*F24F 13/20* (2006.01)

(52) U.S. Cl.
CPC ..... *F24F 13/20* (2013.01); *F24F 2221/26* (2013.01)

(58) Field of Classification Search
CPC ..... F24F 13/20; F24F 2221/26; F24F 1/0047
See application file for complete search history.

(56) References Cited

U.S. PATENT DOCUMENTS 10,352,573 B2 * 7/2019 Hatakeyama ..... F24F 1/0047
2005/0042057 A1 * 2/2005 Konig ..... F16B 37/043 411/103
2016/0123606 A1 5/2016 Furuta et al.

FOREIGN PATENT DOCUMENTS

CN 104344532 A 2/2015
EP 2390515 A1 11/2011
(Continued)

OTHER PUBLICATIONS

International Search Report dated Feb. 12, 2019, issued in corresponding International Application No. PCT/JP2018/043726.
(Continued)

*Primary Examiner* — Lionel Nouketcha
(74) *Attorney, Agent, or Firm* — POSZ LAW GROUP, PLC

(57) ABSTRACT

Operation of fastening a decorative-panel mounting screw into a screw-fastening hole of an indoor-unit body is facilitated.

A decorative panel includes a decorative-panel body, a decorative-panel mounting component, and a decorative-panel mounting screw. The decorative-panel mounting screw is used to, when the decorative-panel mounting screw is inserted through a second screw-insertion hole in the decorative-panel mounting component and a first screw-insertion hole in the decorative-panel body and fastened into a screw-fastening hole, cause a first mounting plate part and a second mounting plate part included in the decorative-panel mounting component to deform such that a mounting surface part included in the decorative-panel mounting component is displaced toward an indoor-unit body, and cause a first protruding engagement part and a second protruding engagement part included in the decorative-panel mounting
(Continued)

component to move to be closer toward each other than before the decorative-panel mounting screw is fastened into the screw-fastening hole.

10 Claims, 5 Drawing Sheets

(56) References Cited

FOREIGN PATENT DOCUMENTS

| | | | |
|---|---|---|---|
| JP | H07-332697 | A | 12/1995 |
| JP | 2011-247295 | A | 12/2011 |
| JP | 2015-034643 | A | 2/2015 |

OTHER PUBLICATIONS

Office Action dated Apr. 29, 2022 issued in corresponding CN patent application No. 201880099652.1 (and English translation).

* cited by examiner

DECORATIVE PANEL AND INDOOR UNIT

CROSS REFERENCE TO RELATED APPLICATION

This application is a U.S. National Stage Application of International Application No. PCT/JP2018/043726, filed on Nov. 28, 2018, the contents of which are incorporated herein by reference.

TECHNICAL FIELD

The present disclosure relates to an indoor unit of an air-conditioning apparatus, and a decorative panel mounted to the indoor unit.

BACKGROUND ART

In some air-conditioning apparatuses, for example, a four-way cassette indoor unit includes a decorative panel mounted with a decorative-panel mounting screw to the indoor-side surface of an indoor-unit body suspended in a space above a ceiling. In some of these air-conditioning apparatuses, a decorative-panel mounting component for retaining the decorative-panel mounting screw is mounted to the decorative panel in advance to ensure that the decorative-panel mounting screw does not have to be held in the hand during mounting of the decorative panel to the indoor-unit body (see, for example, Patent Literature 1).

CITATION LIST

Patent Literature

Patent Literature 1: Japanese Unexamined Patent Application Publication No. 2015-034643

SUMMARY OF INVENTION

Technical Problem

In Patent Literature 1, the decorative-panel mounting component has a plate-shaped mounting part that extends in the longitudinal direction. The mounting part has a mounting surface part in its central portion. The mounting surface part has a screw locking hole used to lock and retain the decorative-panel mounting screw in place. The mounting part has a claw part at each end that is fit and locked into a claw-locking hole provided in the decorative panel. The mounting part has an elastically deformable curved part between the mounting surface part and each of the claw parts. In mounting the decorative panel, as the decorative-panel mounting screw is rotated and fastened into a screw-fastening hole provided in the indoor-unit body, the mounting surface part can be displaced toward the indoor-unit body with the curved part elastically deformed.

With the decorative-panel mounting component described in Patent Literature 1, the curved part is elastically deformed to allow displacement of the mounting surface part toward the indoor-unit body. This configuration necessitates rotating the decorative-panel mounting screw while pressing the decorative-panel mounting screw with a force large enough to allow elastic deformation of the curved part. Ease of operation is thus reduced.

The present disclosure aims to solve the above-mentioned problem, and an object of the present disclosure is to facilitate the operation of fastening the decorative-panel mounting screw into the screw-fastening hole provided in the indoor-unit body.

Solution to Problem

A decorative panel according to one embodiment of the present disclosure includes a decorative-panel body, a decorative-panel mounting component, and a decorative-panel mounting screw. The decorative-panel body is mounted to an indoor-unit body, and has a first recessed engagement part, a second recessed engagement part, and a first screw-insertion hole located between the first recessed engagement part and the second recessed engagement part. The decorative-panel mounting component has a first mounting plate part, a second mounting plate part, a mounting surface part, a first protruding engagement part, and a second protruding engagement part. The mounting surface part is located between the first mounting plate part and the second mounting plate part, and has a second screw-insertion hole. The first protruding engagement part and the second protruding engagement part are respectively provided to the first mounting plate part and the second mounting plate part. The first protruding engagement part and the second protruding engagement part are respectively engaged with the first recessed engagement part and the second recessed engagement part such that the first protruding engagement part and the second protruding engagement part are movable. The decorative-panel mounting screw is used to, when the decorative-panel mounting screw is inserted through the second screw-insertion hole and the first screw-insertion hole and fastened into a screw-fastening hole provided in the indoor-unit body, cause the first mounting plate part and the second mounting plate part to deform such that the mounting surface part is displaced toward the indoor-unit body, and cause the first protruding engagement part and the second protruding engagement part to move to be closer toward each other than before the decorative-panel mounting screw is fastened into the screw-fastening hole.

A decorative panel according to another embodiment of the present disclosure includes a decorative-panel body, a decorative-panel mounting component, and a decorative-panel mounting screw. The decorative-panel body is mounted to an indoor-unit body, and has a first protruding engagement part, a second protruding engagement part, and a first screw-insertion hole located between the first protruding engagement part and the second protruding engagement part. The decorative-panel mounting component has a first mounting plate part, a second mounting plate part, a mounting surface part, a first recessed engagement part, and a second recessed engagement part. The mounting surface part is located between the first mounting plate part and the second mounting plate part, and has a second screw-insertion hole. The first recessed engagement part and the second recessed engagement part are respectively provided to the first mounting plate part and the second mounting plate part. The first recessed engagement part and the second recessed engagement part are movable in a state where the first recessed engagement part and the second recessed engagement part are respectively engaged with the first protruding engagement part and the second protruding engagement part. The decorative-panel mounting screw is used to, when the decorative-panel mounting screw is inserted through the second screw-insertion hole and the first screw-insertion hole and fastened into a screw-fastening hole provided in the indoor-unit body, cause the first mounting plate part and the second mounting plate part to deform such that the mounting surface part is displaced toward the indoor-unit body, and cause the first recessed engagement part and the second recessed engagement part to move to be closer toward each other than before the decorative-panel mounting screw is fastened into the screw-fastening hole.

An indoor unit according to still another embodiment of the present disclosure includes the indoor-unit body having the screw-fastening hole, and the decorative panel mounted to the indoor-unit body by fastening the decorative-panel mounting screw into the screw-fastening hole.

Advantageous Effects of Invention

With the decorative panel and the indoor unit according to an embodiment of the present disclosure, fastening the decorative-panel mounting screw into the screw-fastening hole causes the mounting surface part of the decorative-panel mounting component to be displaced toward the indoor-unit body, and causes the first mounting plate part and the second mounting plate part to move toward each other. This configuration facilitates the operation of fastening the decorative-panel mounting screw into the screw-fastening hole provided in the indoor-unit body.

DESCRIPTION OF EMBODIMENTS

Figure 1:
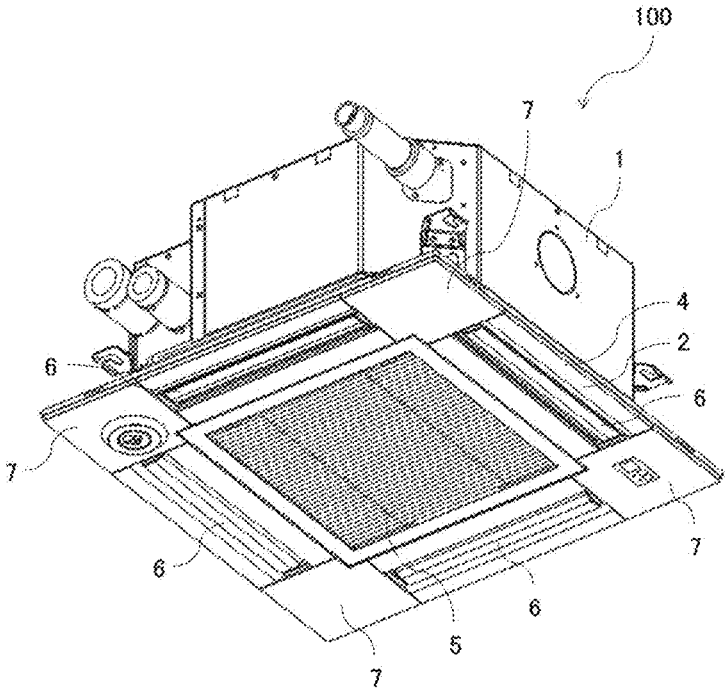
FIG. 1 is an external perspective view of an indoor unit according to Embodiment 1 of the present disclosure.

An air-conditioning apparatus according to embodiments of the present disclosure is described below with reference to the drawings. In the drawings below, the same reference signs refer to the same or corresponding elements in the following description of embodiments. The specific forms or configurations of components described in the specification are merely examples and the forms or configurations of components are not limited to those describes in the specification. Further, in the drawings below, the relative sizes of components may differ from the actuality.

Embodiment 1

Figure 2:
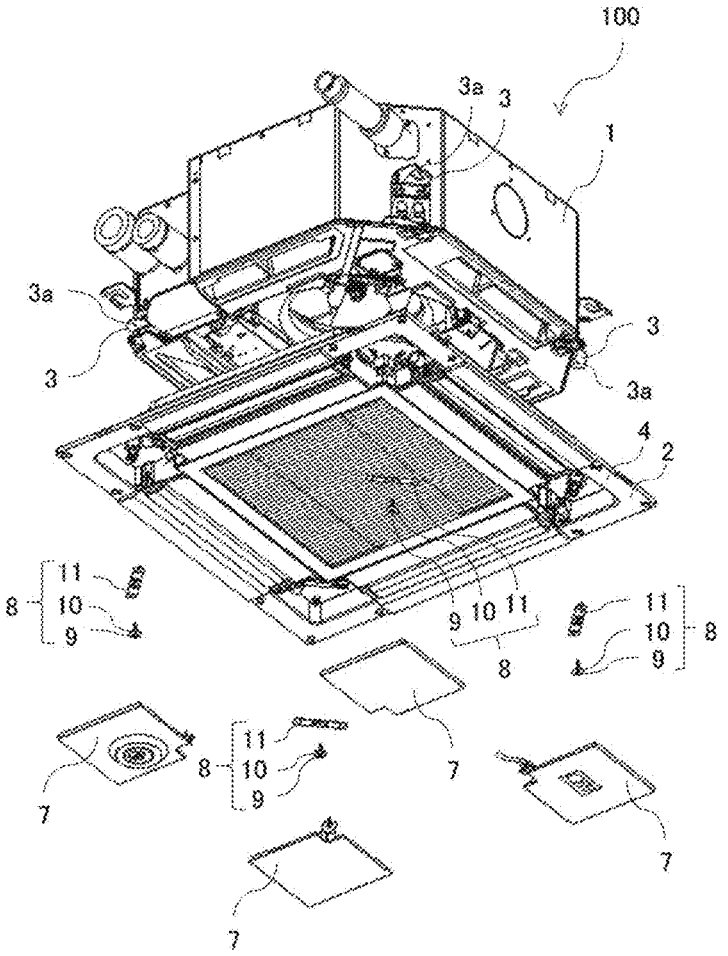
FIG. 2 is an exploded perspective view of the indoor unit according to Embodiment 1 of the present disclosure.
Figure 3:
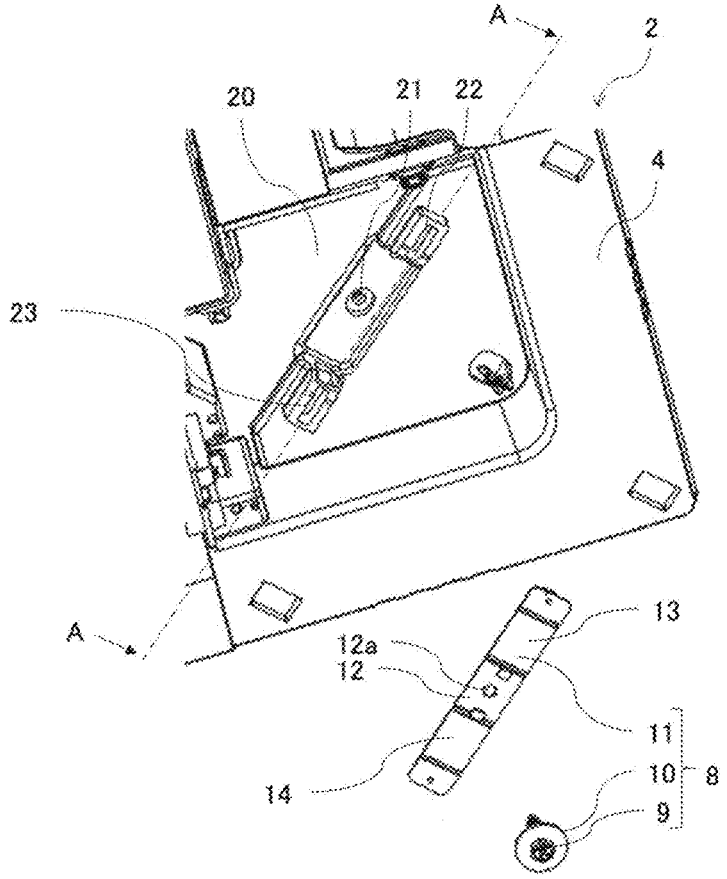
FIG. 3 is an enlarged perspective view of a corner portion of a decorative panel according to Embodiment 1 of the present disclosure.

The configuration of an indoor unit 100 of an air-conditioning apparatus according to Embodiment 1 of the present disclosure is described below with reference to FIGS. 1 to 3. FIG. 1 is an external perspective view of the indoor unit 100 according to Embodiment 1 of the present disclosure. FIG. 2 is an exploded perspective view of the indoor unit 100 according to Embodiment 1 of the present disclosure. FIG. 3 is an enlarged perspective view of a corner portion of a decorative panel 2 of the indoor unit 100 according to Embodiment 1 of the present disclosure. A four-way cassette air-conditioning apparatus that sends air indoors in four directions is described below as an exemplary air-conditioning apparatus.

As illustrated in FIGS. 1 and 2, the indoor unit 100 includes an indoor-unit body 1 and the decorative panel 2. The indoor-unit body 1 is open on its face at an indoor space, that is, its lower face illustrated in FIGS. 1 and 2. The decorative panel 2 is mounted to the lower face of the indoor-unit body 1, and has a substantially rectangular shape. The indoor-unit body 1 is disposed in a space above a ceiling in the orientation illustrated in FIGS. 1 and 2. The decorative panel 2 is disposed in the indoor space. As used in the following description, terms such as "upper", "upward", and "above" refer to areas in and around the indoor unit 100 close to the ceiling, that is, the upper areas illustrated in FIG. 1, and terms such as "lower", "downward", and "below" refer to areas in and around the indoor unit 100 close to the indoor space, that is the lower areas illustrated in FIG. 1.

The indoor-unit body 1 has four corner portions and a mounting part 3 for mounting the decorative panel 2 projects outward from each of the four corner portions of the indoor-unit body 1. The mounting part 3 has a screw-fastening hole 3*a*. A decorative-panel mounting screw 9 of a mounting unit 8 described later is fastened into each of the screw-fastening holes 3*a* to mount the decorative panel 2 to the indoor-unit body 1.

The decorative panel 2 includes a decorative-panel body 4, and the mounting units 8 mounted on the decorative-panel body 4. The decorative-panel body 4 has four sides and an air inlet 5 provided in its central portion to suction air into the indoor-unit body 1, with an air outlet 6 provided around the air inlet 5 along each of the four sides of the decorative-panel body 4 to blow conditioned air indoors. The decorative-panel body 4 has four corner portions and a corner panel 7 is attached on each of the four corner portions of the decorative-panel body 4 such that the corner panel 7 is removable. During various operations, the corner panel 7 can be removed to allow such operations to be performed.

Each of the four corner portions of the decorative-panel body 4 has a mounting-component placement part 20 as illustrated in FIG. 3. The mounting-component placement part 20 has a first screw-insertion hole 21, and a first recessed engagement part 22 and a second recessed engagement part 23. The first screw-insertion hole 21 is provided at a location corresponding to the screw-fastening hole 3*a*. The first recessed engagement part 22 and the second recessed engagement part 23 are located opposite to each other across the first screw-insertion hole 21. A first protruding engagement part 15 and a second protruding engagement part 16 of a decorative-panel mounting component 11, which are described later, are respectively engaged with the first recessed engagement part 22 and the second recessed engagement part 23.

The first recessed engagement part 22 and the second recessed engagement part 23 are elongated holes extending in a direction orthogonal to the axial direction of the first screw-insertion hole 21, and are arranged in a straight line. A space is defined inside each of the first recessed engagement part 22 and the second recessed engagement part 23 such that the first protruding engagement part 15 and the second protruding engagement part 16 are allowed to move in the longitudinal direction. This configuration causes the first protruding engagement part 15 and the second protruding engagement part 16 to be fixed in place such that the first protruding engagement part 15 and the second protruding engagement part 16 are not allowed to be displaced in the lateral directions of the first recessed engagement part 22 and the second recessed engagement part 23, and this configuration allows the first protruding engagement part 15 and the second protruding engagement part 16 to be displaced in the longitudinal direction.

The mounting unit 8 used to mount the decorative-panel body 4 to the indoor-unit body 1 is described below in detail. Each of the mounting units 8 includes the decorative-panel mounting screw 9, a washer 10, and the decorative-panel mounting component 11.

Figure 4:
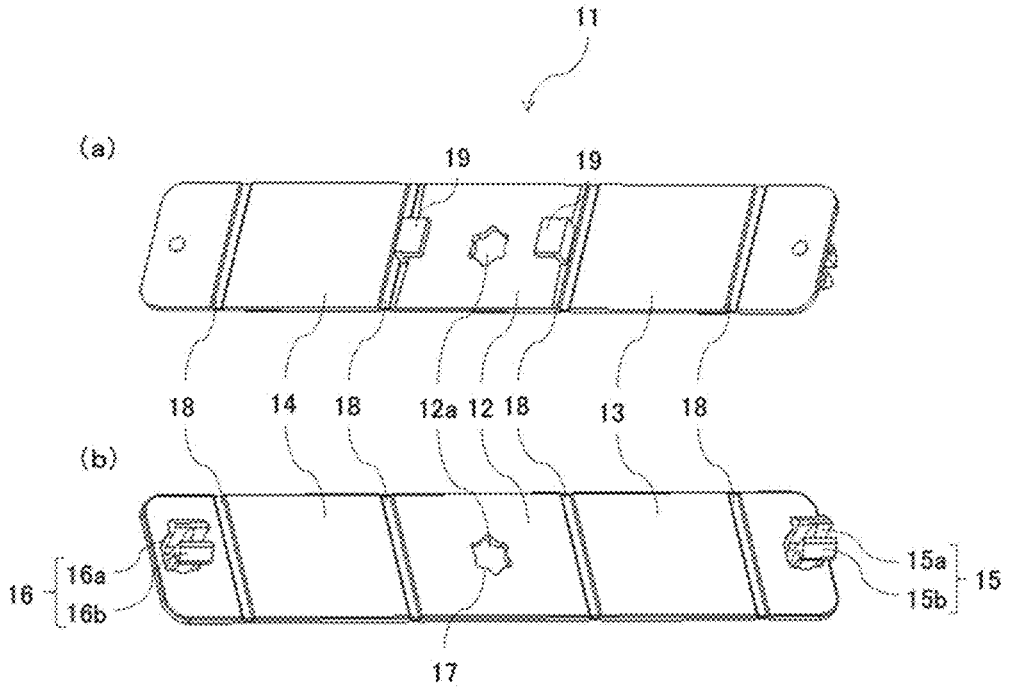
FIG. 4 includes enlarged perspective views of a decorative-panel mounting component according to Embodiment 1 of the present disclosure.

FIG. 4 includes enlarged perspective views of the decorative-panel mounting component 11 of the indoor unit 100 according to Embodiment 1 of the present disclosure. FIG. 4(*a*) is an illustration, viewed from below, of the decorative-panel mounting component 11 to be mounted on the decorative-panel body 4. FIG. 4(*b*) is an illustration, viewed from above, of the decorative-panel mounting component 11 to be mounted on the decorative-panel body 4.

As illustrated in FIG. 4, the decorative-panel mounting component 11 has a mounting surface part 12, a first mounting plate part 13, and a second mounting plate part 14. The mounting surface part 12 has a second screw-insertion hole 12*a* at a location corresponding to the first screw-insertion hole 21. The first mounting plate part 13 and the second mounting plate part 14 are located opposite to each other across the mounting surface part 12, and extend in opposite directions away from the mounting surface part 12. The decorative-panel mounting component 11 is made of, for example, a resin material. The first mounting plate part 13 and the second mounting plate part 14 are respectively provided at their ends with the first protruding engagement part 15 and the second protruding engagement part 16, which are respectively engaged with the first recessed engagement part 22 and the second recessed engagement part 23 such that the first protruding engagement part 15 and the second protruding engagement part 16 are movable.

The first protruding engagement part 15 and the second protruding engagement part 16 each have the shape of a claw that allows the first protruding engagement part 15 and the second protruding engagement part 16 to respectively catch in the first recessed engagement part 22 and the second recessed engagement part 23. More specifically, the first protruding engagement part 15 has a boss part 15*a*, and a pair of claw parts 15*b* located at the distal end of the boss part 15*a*. The pair of claw parts 15*b* at the distal end of the boss part 15*a* protrude outward in the lateral direction of the decorative-panel mounting component 11. The boss part 15*a* is capable of elastically deforming in a manner that allows the pair of claw parts 15*b* to move toward each other in the lateral direction of the decorative-panel mounting component 11. The first protruding engagement part 15 is thus inserted into and engaged with the first recessed engagement part 22 while the first protruding engagement part 15 is elastically deforming in such a manner. As with the first protruding engagement part 15, the second protruding engagement part 16 has a boss part 16*a*, and a pair of claw parts 16*b* located at the distal end of the boss part 16*a*, and is inserted into and engaged with the second recessed engagement part 23.

The second screw-insertion hole 12*a* is in the shape of a star with six projections 17 spaced from each other and projecting inward from the inner periphery surface of the second screw-insertion hole 12*a*. As the second screw-insertion hole 12*a* has the projections 17, the second screw-insertion hole 12*a* defines a space narrower than the diameter of the shank of the decorative-panel mounting screw 9. This configuration allows the decorative-panel mounting screw 9 to be locked and retained in the second screw-insertion hole 12*a* with the head of the decorative-panel mounting screw 9 facing down.

The first mounting plate part 13 has two bendable hinge parts 18 provided between the mounting surface part 12 and the first protruding engagement part 15. Likewise, the second mounting plate part 14 has two bendable hinge parts 18 provided between the mounting surface part 12 and the second protruding engagement part 16. Each hinge part 18 is, for example, a groove with a thin part. Bending each mounting plate part at the hinge parts 18 enables displacement of the height position of the mounting surface part 12.

The mounting surface part 12 has two catching parts 19 provided on a face of the mounting surface part 12 opposite to the face on which the first protruding engagement part 15 and the second protruding engagement part 16 are provided. The catching parts 19 retain the washer 10 such that the second screw-insertion hole 12*a* is located between the catching parts 19 in the longitudinal direction.

A procedure is described below for mounting the decorative-panel body 4 to the indoor-unit body 1 by use of the decorative-panel mounting component 11 formed as described above.

Figure 5:
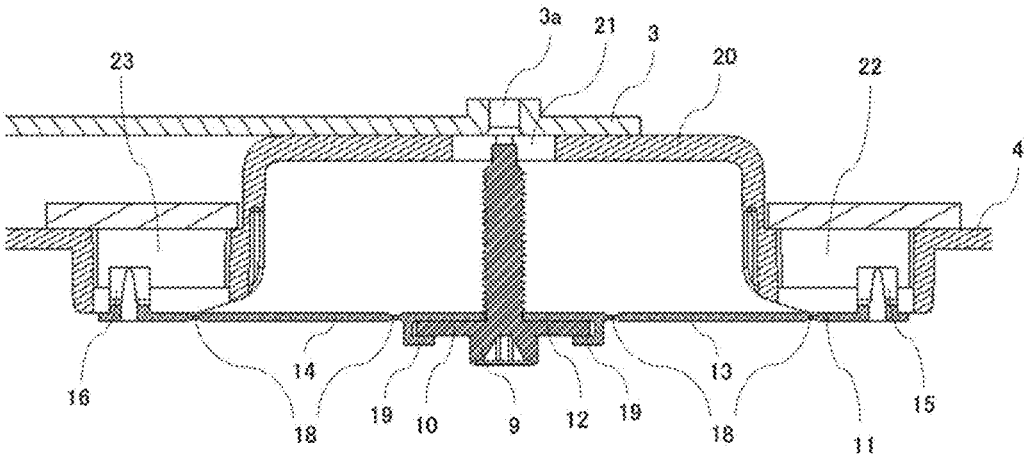
FIG. 5 illustrates a cross-section along A-A of a corner portion of the decorative panel of the indoor unit according to Embodiment 1 of the present disclosure, with the decorative panel temporarily placed over the indoor-unit body.
Figure 6:
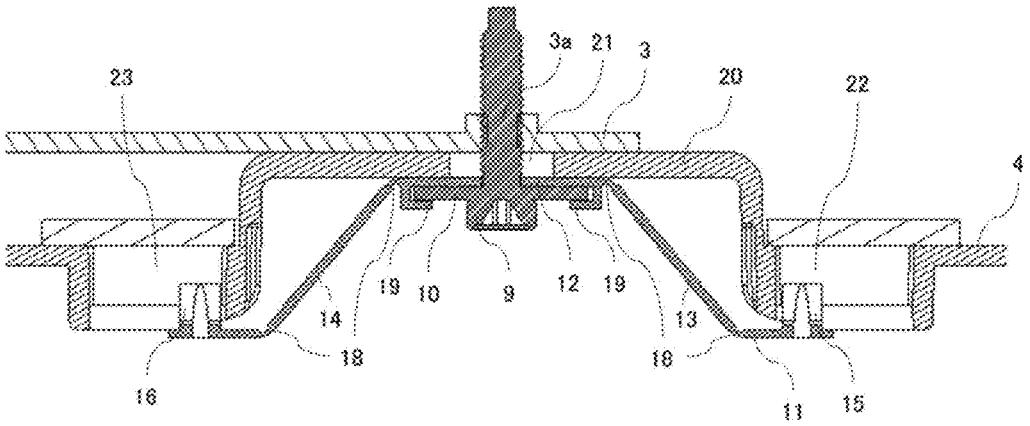
FIG. 6 illustrates a cross-section along A-A of a corner portion of the decorative panel of the indoor unit according to Embodiment 1 of the present disclosure, with the decorative panel mounted on the indoor-unit body.
Figure 7:
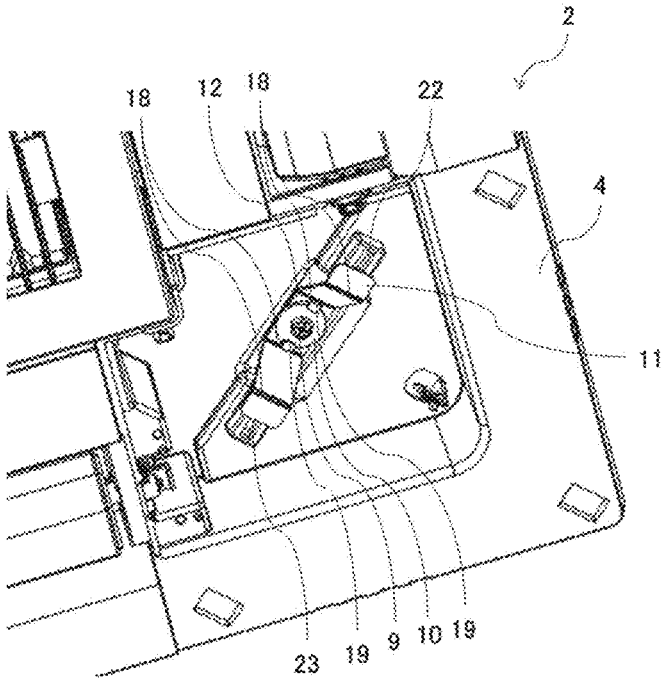
FIG. 7 is an enlarged perspective view of a corner portion of the decorative panel of the indoor unit according to Embodiment 1 of the present disclosure, with the decorative panel mounted on the indoor-unit body.

FIG. 5 illustrates a cross-section along A-A of a corner portion of the decorative panel 2 of the indoor unit 100 according to Embodiment 1 of the present disclosure, with the decorative panel 2 temporarily placed over the indoor-unit body 1. FIG. 6 illustrates a cross-section along A-A of a corner portion of the decorative panel 2 of the indoor unit 100 according to Embodiment 1 of the present disclosure, with the decorative panel 2 mounted on the indoor-unit body 1. FIG. 7 is an enlarged perspective view of a corner portion of the decorative panel 2 of the indoor unit 100 according to Embodiment 1 of the present disclosure, with the decorative panel 2 mounted on the indoor-unit body 1.

A procedure is described below for attaching the mounting unit 8 to the decorative-panel body 4 at the time of shipping. First, the decorative-panel mounting component 11 is temporarily secured to each mounting-component placement part 20 of the decorative-panel body 4 with the corner panels 7 removed from the decorative-panel body 4. That is, the first protruding engagement part 15 and the second protruding engagement part 16 of the decorative-panel mounting component 11 are respectively engaged with the first recessed engagement part 22 and the second recessed engagement part 23, and the washer 10 is fit into each pair of catching parts 19 of the decorative-panel mounting component 11. The decorative-panel mounting screw 9 is then inserted and locked into each second screw-insertion hole 12*a* with the head of the decorative-panel mounting screw 9 facing down. After the mounting units 8 are temporarily secured to the mounting-component placement parts 20, the decorative panel 2 is shipped, together with the indoor-unit body 1, with the mounting-component placement parts 20 covered by the corner panels 7.

On the site where the air-conditioning apparatus is to be installed, the installation operator first removes the corner panels 7 to expose the areas where the mounting units 8 are temporarily secured. Then, the decorative panel 2 is temporarily placed over the indoor-unit body 1 by use of a locking unit, which is not illustrated. As illustrated in FIG. 5, with the decorative panel 2 temporarily placed over the indoor-unit body 1, the decorative-panel mounting screw 9 is positioned coaxially with the screw-fastening hole 3*a* and the first screw-insertion hole 21, and the distal end of the decorative-panel mounting screw 9 is positioned inside the first screw-insertion hole 21. In this state, the first mounting plate part 13 and the second mounting plate part 14 of the decorative-panel mounting component 11 are in their horizontal position without bending at the hinge parts 18.

Subsequently, as the decorative-panel mounting screw 9 is rotated and fastened into the screw-fastening hole 3*a*, the decorative-panel mounting component 11 bends at the hinge parts 18, and the first protruding engagement part 15 and the second protruding engagement part 16 slide toward each other respectively along the first recessed engagement part 22 and the second recessed engagement part 23. The mounting surface part 12 is thus displaced upward.

Once fastening each decorative-panel mounting screw 9 into the screw-fastening hole 3*a* is completed and, as illustrated in FIG. 6, each mounting surface part 12 is displaced into contact with the lower surface of the mounting-component placement part 20, mounting the decorative panel 2 is completed.

As described above, with the indoor unit 100 according to Embodiment 1, as the decorative-panel mounting screw 9 is fastened into the screw-fastening hole 3*a*, the decorative-panel mounting component 11 bends at the hinge parts 18, and the first protruding engagement part 15 and the second protruding engagement part 16 slide toward each other respectively along the first recessed engagement part 22 and the second recessed engagement part 23. Thus, unlike in some air-conditioning apparatuses, the mounting surface part 12 can be displaced upward without application of a force large enough to deform an elastic curved part. This configuration facilitates the operation of fastening the decorative-panel mounting screw 9 into the screw-fastening hole 3*a*.

In fastening the decorative-panel mounting screw 9 into the screw-fastening hole 3*a*, the mounting surface part 12 can be freely changed in height position by changing how much the first protruding engagement part 15 and the second protruding engagement part 16 are slid. This configuration allows a single kind of decorative-panel mounting component to be used for, for example, different models that differ in the height position of the mounting part 3 of the indoor-unit body 1.

The decorative-panel mounting component 11 is retained onto the decorative-panel body 4 by simply engaging the first protruding engagement part 15 and the second protruding engagement part 16, which are claw-shaped, with the first recessed engagement part 22 and the second recessed engagement part 23, respectively. This configuration allows for ease of assembly and improved serviceability.

The mounting unit 8 is retained on the decorative-panel body 4 in a manner that prevents the mounting unit 8 from dislodging from the decorative-panel body 4. This configuration eliminates the need to hold the decorative-panel mounting screw 9 in the hand during mounting of the decorative panel 2 to the indoor-unit body 1, and thus allows for improved operational efficiency.

In the decorative-panel mounting component 11, the second screw-insertion hole 12*a* for temporarily securing the decorative-panel mounting screw 9 in place is shaped to have the projections 17 to ensure that the decorative-panel mounting screw 9 does not easily come off. This configuration allows for improved ease of mounting.

Embodiment 2

Figure 8:
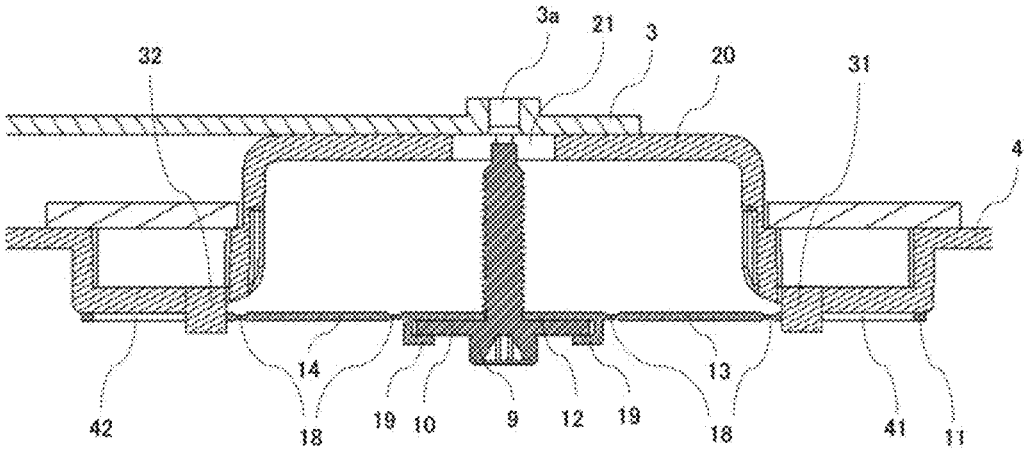
FIG. 8 illustrates a cross-section along A-A of a corner portion of the decorative panel of the indoor unit according to Embodiment 2 of the present disclosure, with the decorative panel temporarily placed over the indoor-unit body.
Figure 9:
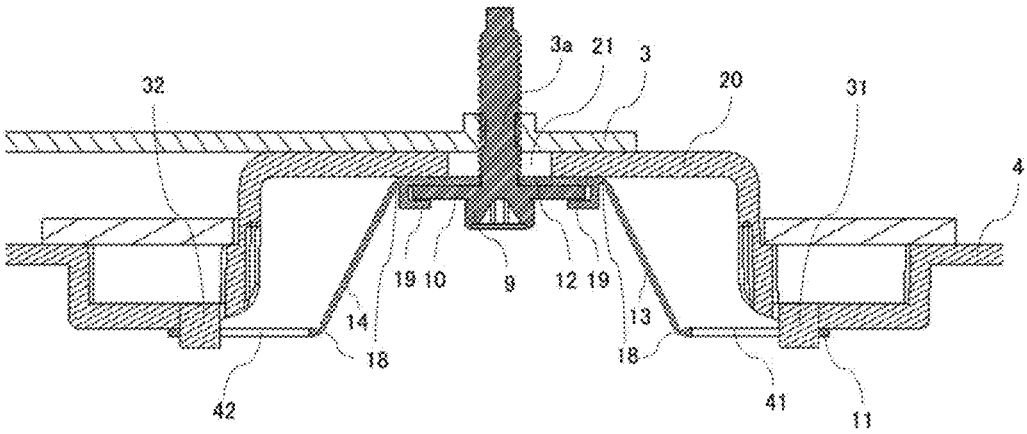
FIG. 9 illustrates a cross-section along A-A of a corner portion of the decorative panel of the indoor unit according to Embodiment 2 of the present disclosure, with the decorative panel mounted on the indoor-unit body.

The indoor unit 100 of an air-conditioning apparatus according to Embodiment 2 of the present disclosure is described below with reference to FIGS. 8 and 9. FIG. 8 illustrates a cross-section along A-A of a corner portion of the decorative panel 2 of the indoor unit 100 according to Embodiment 2 of the present disclosure, with the decorative panel 2 temporarily placed over the indoor-unit body 1. FIG. 9 illustrates a cross-section along A-A of a corner portion of the decorative panel 2 of the indoor unit 100 according to Embodiment 2 of the present disclosure, with the decorative panel 2 mounted on the indoor-unit body 1.

In the indoor unit 100 according to Embodiment 1, the first protruding engagement part 15 and the second protruding engagement part 16, which are provided to the decorative-panel mounting component 11, are respectively engaged with the first recessed engagement part 22 and the second recessed engagement part 23, which are provided to the decorative-panel body 4. In the indoor unit 100 according to Embodiment 2, the location of protruding engagement parts and the location of recessed engagement parts are reversed from those according to Embodiment 1. That is, the decorative-panel body 4 is provided with a first protruding engagement part 31 and a second protruding engagement part 32 that protrude downward, and the decorative-panel mounting component 11 is provided with a first recessed engagement part 41 and a second recessed engagement part 42 with which the first protruding engagement part 31 and the second protruding engagement part 32 are respectively engaged.

The first protruding engagement part 31 and the second protruding engagement part 32 are disposed opposite to each other across the first screw-insertion hole 21 and project downward. Like the first protruding engagement part 15 and the second protruding engagement part 16 according to Embodiment 1, the first protruding engagement part 31 and the second protruding engagement part 32 are each in the shape of a claw with a boss part and claw parts such that the first protruding engagement part 31 and the second protruding engagement part 32 respectively catch in the first recessed engagement part 41 and the second recessed engagement part 42.

The first recessed engagement part 41 and the second recessed engagement part 42, which are provided to the decorative-panel mounting component 11, are elongated holes extending in a direction orthogonal to the axial direction of the second screw-insertion hole 12*a*. The first recessed engagement part 41 and the second recessed engagement part 42 are capable of moving in the longitudinal direction in a state where the first recessed engagement part 41 and the second recessed engagement part 42 are respectively engaged with the first protruding engagement part 31 and the second protruding engagement part 32. This configuration causes the first recessed engagement part 41 and the second recessed engagement part 42 to be fixed in place such that the first recessed engagement part 41 and the second recessed engagement part 42 are not allowed to be displaced in the lateral directions, and this configuration allows the first recessed engagement part 41 and the second recessed engagement part 42 to be displaced in the longitudinal direction.

Except that the decorative-panel body 4 is provided not with the first recessed engagement part 22 and the second recessed engagement part 23 but with the first protruding engagement part 31 and the second protruding engagement part 32, and that the decorative-panel mounting component 11 is provided not with the first protruding engagement part 15 and the second protruding engagement part 16 but with the first recessed engagement part 41 and the second recessed engagement part 42, Embodiment 2 is similar in configuration to Embodiment 1 and thus the configuration of Embodiment 2 is not described in further detail.

A procedure is described below for mounting the decorative-panel body 4 to the indoor-unit body 1 in the indoor unit 100 according to Embodiment 2.

First, the decorative-panel mounting component 11 is temporarily secured to each mounting-component placement part 20 of the decorative-panel body 4 with the corner panels 7 removed from the decorative-panel body 4. That is, the first protruding engagement part 31 and the second protruding engagement part 32 of the decorative-panel body 4 are respectively engaged with the first recessed engagement part 41 and the second recessed engagement part 42 of the decorative-panel mounting component 11, and the washer 10 is fit into each pair of catching parts 19 of the decorative-panel mounting component 11. The decorative-panel mounting screw 9 is then inserted and locked into each second screw-insertion hole 12*a* with the head of the decorative-panel mounting screw 9 facing down. After the mounting units 8 are temporarily secured to the mounting-component placement parts 20, the decorative panel 2 is shipped, together with the indoor-unit body 1, with the mounting-component placement parts 20 covered by the corner panels 7.

On the site where the air-conditioning apparatus is to be installed, the installation operator first removes the corner panels 7 to expose the areas where the mounting units 8 are temporarily secured. Then, the decorative panel 2 is temporarily placed over the indoor-unit body 1 by use of a locking unit, which is not illustrated. As illustrated in FIG. 8, with the decorative panel 2 temporarily placed over the indoor-unit body 1, the decorative-panel mounting screw 9 is positioned coaxially with the screw-fastening hole 3*a* and the first screw-insertion hole 21, and the distal end of the decorative-panel mounting screw 9 is positioned inside the first screw-insertion hole 21. In this state, the first mounting plate part 13 and the second mounting plate part 14 of the decorative-panel mounting component 11 are in their horizontal position without bending at the hinge parts 18.

Subsequently, as the decorative-panel mounting screw 9 is rotated and fastened into the screw-fastening hole 3*a*, the decorative-panel mounting component 11 bends at the hinge parts 18, and the first recessed engagement part 41 and the second recessed engagement part 42 slide toward each other in a state where the first recessed engagement part 41 and the second recessed engagement part 42 are respectively engaged with the first protruding engagement part 31 and the second protruding engagement part 32. The mounting surface part 12 is thus displaced upward.

Once fastening each decorative-panel mounting screw 9 into the screw-fastening hole 3*a* is completed and, as illustrated in FIG. 9, each mounting surface part 12 is displaced into contact with the lower surface of the mounting-component placement part 20, mounting the decorative panel 2 is completed.

As described above, with the indoor unit 100 according to Embodiment 2, as the decorative-panel mounting screw 9 is fastened into the screw-fastening hole 3*a*, the decorative-panel mounting component 11 bends at the hinge parts 18, and the first recessed engagement part 41 and the second recessed engagement part 42 slide toward each other in a state where the first recessed engagement part 41 and the second recessed engagement part 42 are respectively engaged with the first protruding engagement part 31 and the second protruding engagement part 32. Thus, unlike in some air-conditioning apparatuses, the mounting surface part 12 can be displaced upward without application of a force large enough to deform an elastic curved part. This configuration facilitates the operation of fastening the decorative-panel mounting screw 9 into the screw-fastening hole 3*a*.

In fastening the decorative-panel mounting screw 9 into the screw-fastening hole 3*a*, the mounting surface part 12 can be freely changed in height position by changing how much the first recessed engagement part 41 and the second recessed engagement part 42 are slid. This configuration allows a single kind of decorative-panel mounting component to be used for, for example, different models that differ in the height position of the mounting part 3 of the indoor-unit body 1.

The decorative-panel mounting component 11 is retained onto the decorative-panel body 4 by simply engaging the first protruding engagement part 31 and the second protruding engagement part 32, which are claw-shaped, with the first recessed engagement part 41 and the second recessed engagement part 42, respectively. This configuration allows for ease of assembly and improved serviceability.

The mounting unit 8 is retained on the decorative-panel body 4 in a manner that prevents the mounting unit 8 from dislodging from the decorative-panel body 4. This configuration eliminates the need to hold the decorative-panel mounting screw 9 in the hand during mounting of the decorative panel 2 to the indoor-unit body 1, and thus allows for improved operational efficiency.

In the decorative-panel mounting component 11, the second screw-insertion hole 12*a* for temporarily securing the decorative-panel mounting screw 9 in place is shaped to have the projections 17 to ensure that the decorative-panel mounting screw 9 does not easily come off. This configuration allows for improved ease of mounting.

The decorative-panel mounting component 11 is not limited to the particular configurations described above with reference to Embodiments 1 and 2.

For example, the first mounting plate part 13 and the second mounting plate part 14 are described above as each having two bendable hinge parts 18. Alternatively, if the first mounting plate part 13 and the second mounting plate part 14 are made of a material that enables deformation of the first mounting plate part 13 and the second mounting plate part 14 in a manner that allows the mounting surface part 12 to be displaced upward, no hinge part 18 needs to be provided. If, for example, the first mounting plate part 13 and the second mounting plate part 14 are made of a flexible resin material, as the decorative-panel mounting screw 9 is fastened into the screw-fastening hole 3*a*, the first mounting plate part 13 and the second mounting plate part 14 can be deformed in a manner that causes the mounting surface part 12 to be displaced upward.

Although each hinge part 18 is described above as being in the form of a groove with a thin part, the hinge part 18 may be any bendable structure. For example, the hinge part 18 may be in the form of a cut slit, or in the form of hinge-joined plates.

Although the first protruding engagement part 15, 31 and the second protruding engagement part 16, 32 are described above as being identical in shape to each other in the lateral direction, the two protruding engagement parts may differ in shape from each other in the lateral direction. The first protruding engagement part 15, 31 and the second protruding engagement part 16, 32 may not necessarily be each in the form of a claw but may be in any other form that allows the first protruding engagement part 15, 31 and the second protruding engagement part 16, 32 to be so engaged respectively with the first recessed engagement part 22, 41 and the second recessed engagement part 23, 42 that the first protruding engagement part 15, 31 and the second protruding engagement part 16, 32 do not dislodge.

Although the decorative-panel mounting component 11 is described above as having the catching parts 19 for retaining the washer 10, the decorative-panel mounting component 11 may not necessarily have the catching parts 19 as long as the decorative-panel mounting component 11 has a structure that allows the washer 10 to be retained by the decorative-panel mounting component 11.

Although the decorative-panel mounting component 11 is described above as being shaped to extend in the longitudinal direction, the decorative-panel mounting component 11 may be, for example, square-shaped. Although the decorative-panel mounting component 11 is described above as being made of a resin material, the decorative-panel mounting component 11 may not necessarily be made of a resin material but may be made of, for example, metal.

The first recessed engagement part 22, 41 and the second recessed engagement part 23, 42 as well are not limited to the particular configurations described above with reference to Embodiments 1 and 2.

For example, although the first recessed engagement part 22 and the second recessed engagement part 23 are described above as each extending in a direction orthogonal to the axial direction of the first screw-insertion hole 21, the first recessed engagement part 22 and the second recessed engagement part 23 may not necessarily extend in a direction orthogonal to the axial direction of the first screw-insertion hole 21 as long as the first recessed engagement part 22 and the second recessed engagement part 23 extend in a direction that extends across the axial direction of the first screw-insertion hole 21. More specifically, although the first recessed engagement part 22 and the second recessed engagement part 23 are described above with reference to Embodiment 1 as extending horizontally, the first recessed engagement part 22 and the second recessed engagement part 23 may not extend completely horizontally. The first recessed engagement part 22 and the second recessed engagement part 23 may extend in any direction such as a direction inclined to the horizontal direction as long as the first protruding engagement part 15 and the second protruding engagement part 16 are allowed to move toward each other. Likewise, although the first recessed engagement part 41 and the second recessed engagement part 42 are described above as each extending in a direction orthogonal to the axial direction of the second screw-insertion hole 12*a*, the first recessed engagement part 41 and the second recessed engagement part 42 may not necessarily extend in a direction orthogonal to the axial direction of the second screw-insertion hole 12*a* as long as the first recessed engagement part 41 and the second recessed engagement part 42 extend in a direction that extends across the axial direction of the second screw-insertion hole 12*a*.

Although the first recessed engagement part 22, 41 and the second recessed engagement part 23, 42 are described above as being each in the form of an elongated hole, the first recessed engagement part 22, 41 and the second recessed engagement part 23, 42 may not necessarily be each in the form of an elongated hole but may be in any other form such as a groove as long as the first protruding engagement part 15, 31 and the second protruding engagement part 16, 32 can be respectively engaged with the first recessed engagement part 22, 41 and the second recessed engagement part 23, 42 in a manner that allows the first protruding engagement part 15 and the second protruding engagement part 16 to move toward each other, and allows the first recessed engagement part 41 and the second recessed engagement part 42 to move toward each other.

Although the first recessed engagement part 22, 41 and the second recessed engagement part 23, 42 are described above as being arranged in a straight line, the first recessed engagement part 22, 41 and the second recessed engagement part 23, 42 may not necessarily be arranged in a straight line but may be arranged in any other manner that allows the first protruding engagement part 15 and the second protruding engagement part 16 to move toward each other, and allows the first recessed engagement part 41 and the second recessed engagement part 42 to move toward each other.

The structure for retaining the decorative-panel mounting screw 9 on the decorative-panel mounting component 11 as well is not limited to the particular structure described above with reference to Embodiments 1 and 2.

Although the second screw-insertion hole 12*a* is described above as having, for example, the shape of a star with six projections 17, the placement and the number of projections 17 can be freely changed as long as the second screw-insertion hole 12*a* has a shape that allows for easy insertion of the decorative-panel mounting screw 9 and for retention of the decorative-panel mounting screw 9.

Although the second screw-insertion hole 12*a* is described above as being shaped to allow for retention of the decorative-panel mounting screw 9, if another structure that allows for retention of the decorative-panel mounting screw 9 is provided, the second screw-insertion hole 12*a* may not be of a structure that allows for retention of the decorative-panel mounting screw 9. For example, if the decorative-panel mounting screw 9 and the washer 10 are of an integrated structure, the washer 10 is retained by the catching parts 19, and the decorative-panel mounting screw 9 integrated with the washer 10 is likewise retained by the decorative-panel mounting component 11. Consequently, even if the second screw-insertion hole 12*a* is not of a structure that allows for retention of the decorative-panel mounting screw 9, the decorative-panel mounting screw 9 can be retained by the decorative-panel mounting component 11.

In the foregoing description of Embodiments 1 and 2, with the decorative panel 2 temporarily placed over the indoor-unit body 1, the decorative-panel mounting screw 9 is positioned coaxially with the screw-fastening hole 3*a* and the first screw-insertion hole 21, and the distal end of the decorative-panel mounting screw 9 is positioned inside the first screw-insertion hole 21. However, the location of the decorative-panel mounting screw 9 in the state where the decorative panel 2 is temporarily placed over the indoor-unit body 1 may not necessarily be that described above with reference to Embodiments 1 and 2. Even if the decorative-panel mounting screw 9 is not positioned coaxially with the screw-fastening hole 3*a* and the first screw-insertion hole 21, and the distal end of the decorative-panel mounting screw 9 is not positioned inside the first screw-insertion hole 21, it is only required that, at the time of mounting the decorative panel 2 to the indoor-unit body 1, the decorative-panel mounting screw 9 be aligned to be positioned coaxially with the screw-fastening hole 3*a* and the first screw-insertion hole 21, and then the distal end of the decorative-panel mounting screw 9 be inserted through the first screw-insertion hole 21 to fasten the decorative-panel mounting screw 9 into the screw-fastening hole 3*a*.

In the foregoing description, with the decorative panel 2 temporarily placed over the indoor-unit body 1, the first mounting plate part 13 and the second mounting plate part 14 of the decorative-panel mounting component 11 are in their horizontal position without bending at the hinge parts 18. However, in this state, the first mounting plate part 13 and the second mounting plate part 14 may bend and sag downward under the weight of the decorative-panel mounting screw 9.

The washer 10 is provided for increasing the area of contact with the decorative-panel mounting component 11 to distribute the contact pressure exerted on the decorative-panel mounting component 11. As such, the washer 10 may not necessarily be provided. The mounting unit 8 may include only two components, that is, the decorative-panel mounting screw 9 and the decorative-panel mounting component 11, as long as the mounting unit 8 is usable to mount the decorative panel 2 to the indoor-unit body 1.

Although the decorative-panel mounting component 11 is described above as being provided to each of the four corner portions of the decorative-panel body 4, the decorative-panel mounting component 11 may not necessarily be provided to each of the four corner portions but may be provided to any location, for example, two diagonal corner portions, as long as the decorative-panel mounting components 11 are usable to mount the decorative panel 2 to the indoor-unit body 1.

Embodiment 3

Figure 10:
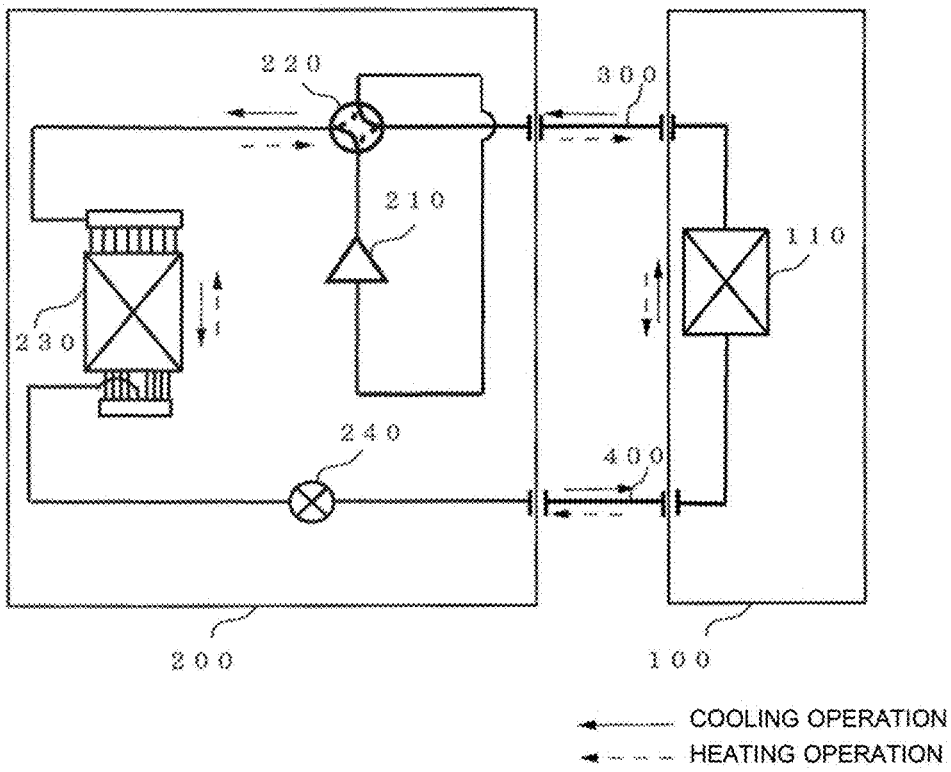
FIG. 10 illustrates an exemplary configuration of an air-conditioning apparatus according to Embodiment 3 of the present disclosure.

An air-conditioning apparatus according to Embodiment 3 of the present disclosure is described below with reference to FIG. 10. FIG. 10 illustrates an exemplary configuration of the air-conditioning apparatus according to Embodiment 3 of the present disclosure. An apparatus employing a refrigeration cycle is illustrated in FIG. 10 as an exemplary air-conditioning apparatus.

In the air-conditioning apparatus illustrated in FIG. 10, an outdoor unit 200, and the indoor unit 100 according to Embodiment 1 or 2 are connected by a gas refrigerant pipe 300 and a liquid refrigerant pipe 400.

The outdoor unit 200 includes a compressor 210, a four-way valve 220, an outdoor heat exchanger 230, and an expansion valve 240.

The compressor 210 compresses and discharges suctioned refrigerant. In one non-limiting example, the compressor 210 may be variable in capacity (the amount of refrigerant sent out per unit time) such that its capacity can be changed as desired by changing the operating frequency of the compressor 210 by use of, for example, an inverter circuit.

The four-way valve 220 is, for example, a valve that switches the flows of refrigerant between cooling operation and heating operation.

The outdoor heat exchanger 230 exchanges heat between refrigerant and outdoor air. For example, during heating operation, the outdoor heat exchanger 230 is used as an evaporator to evaporate and gasify refrigerant. During cooling operation, the outdoor heat exchanger 230 is used as a condenser to condense and liquefy refrigerant.

The expansion valve 240 reduces the pressure of refrigerant to cause the refrigerant to expand. The expansion valve 240 is an expansion device, a flow control unit, or other components. If the expansion valve 240 is, for example, an electronic expansion valve, its opening degree is adjusted in accordance with an instruction from a controller, which is not illustrated.

The indoor unit 100 includes an indoor heat exchanger 110. The indoor heat exchanger 110 exchanges heat between refrigerant and air to be air-conditioned. For example, during heating operation, the indoor heat exchanger 110 is used as a condenser to condense and liquefy refrigerant. During cooling operation, the indoor heat exchanger 110 is used as an evaporator to evaporate and gasify refrigerant.

With the air-conditioning apparatus described above, the flows of refrigerant are switched by the four-way valve 220 of the outdoor unit 200 to achieve heating operation and cooling operation.

The indoor unit 100 includes the indoor heat exchanger 110 accommodated in the indoor-unit body 1 and is covered by the decorative panel 2. As with Embodiments 1 and 2, the decorative panel 2 is mounted to the lower face of the indoor-unit body 1.

According to Embodiment 3, in mounting the decorative panel 2 to the indoor-unit body 1 of an air-conditioning apparatus capable of achieving heating operation and cooling operation, as the decorative-panel mounting screw 9 is fastened into the screw-fastening hole 3*a*, the mounting surface part 12 of the decorative-panel mounting component 11 is displaced upward, and the first mounting plate part 13 and the second mounting plate part 14 move toward each other. This configuration facilitates the operation of fastening the decorative-panel mounting screw 9 into the screw-fastening hole 3*a*.

Although the foregoing description of Embodiments 1 to 3 is directed to the indoor unit 100 of a four-way cassette air-conditioning apparatus that blows out air in four directions, the foregoing description is also applicable to, for example, an indoor unit that blows out air in two, three, or other numbers of directions. Although the foregoing description is directed to the indoor unit 100, which is embedded in a ceiling, the foregoing description is also applicable to an air-conditioning apparatus including an indoor unit that is not embedded in a ceiling but exposed. Although the foregoing description is directed to an air-conditioning apparatus capable of heat exchange using a refrigeration cycle, the foregoing description is also applicable to apparatuses that do not use a refrigeration cycle, such as a fan and a ventilator. As described above, the present disclosure is applicable to any decorative panel that is mounted to an indoor unit of an air-conditioning apparatus.

REFERENCE SIGNS LIST

1 indoor-unit body 2 decorative panel 3 mounting part 3*a* screw-fastening hole 4 decorative-panel body 5 air inlet 6 air outlet 7 coiner panel 8 mounting unit 9 decorative-panel mounting screw 10 washer 11 decorative-panel mounting component 12 mounting surface part 12*a* second screw-insertion hole 13 first mounting plate part 14 second mounting plate part 15 first protruding engagement part 16 second protruding engagement part 17 projection 18 hinge part 19 catching part 20 mounting-component placement part 21 first screw-insertion hole 22 first recessed engagement part 23 second recessed engagement part 31 first protruding engagement part 32 second protruding engagement part 41 first recessed engagement part 42 second recessed engagement part 100 indoor unit 110 indoor heat exchanger 200 outdoor unit 210 compressor 220 four-way valve 230 outdoor heat exchanger 240 expansion valve 300 gas refrigerant pipe 400 liquid refrigerant pipe

The invention claimed is:

1. A decorative panel comprising:

a decorative-panel body mounted to an indoor-unit body, the decorative-panel body having a first recessed engagement part, a second recessed engagement part, and a first screw-insertion hole, the first screw-insertion hole being located between the first recessed engagement part and the second recessed engagement part;

a decorative-panel mounting component having a first mounting plate part, a second mounting plate part, a mounting surface part, a first protruding engagement part, and a second protruding engagement part, the mounting surface part being located between the first mounting plate part and the second mounting plate part and having a second screw-insertion hole, the first protruding engagement part and the second protruding engagement part being respectively provided to the first mounting plate part and the second mounting plate part, the first protruding engagement part and the second protruding engagement part being respectively engaged with the first recessed engagement part and the second recessed engagement part such that the first protruding engagement part and the second protruding engagement part are movable; and a decorative-panel mounting screw used to, when the decorative-panel mounting screw is inserted through the second screw-insertion hole and the first screw-insertion hole and fastened into a screw-fastening hole provided in the indoor-unit body, cause the first mounting plate part and the second mounting plate part to deform such that the mounting surface part is displaced toward the indoor-unit body, and cause the first protruding engagement part and the second protruding engagement part to move to be closer toward each other than before the decorative-panel mounting screw is fastened into the screw-fastening hole.

2. The decorative panel of claim 1, wherein the first mounting plate part and the second mounting plate part each have two bendable hinge parts.

3. The decorative panel of claim 1, wherein the first recessed engagement part and the second recessed engagement part each comprise an elongated hole, and wherein the first protruding engagement part and the second protruding engagement part each have a shape of a claw that catches in the elongated hole.

4. The decorative panel of claim 1, wherein the first protruding engagement part and the second protruding engagement part are identical in shape to each other.

5. An indoor unit comprising:

the indoor-unit body having the screw-fastening hole; and the decorative panel of claim 1, the decorative panel being mounted to the indoor-unit body by fastening the decorative-panel mounting screw into the screw-fastening hole.

6. A decorative panel comprising:

a decorative-panel body mounted to an indoor-unit body, the decorative-panel body having a first protruding engagement part, a second protruding engagement part, and a first screw-insertion hole, the first screw-insertion hole being located between the first protruding engagement part and the second protruding engagement part;

a decorative-panel mounting component having a first mounting plate part, a second mounting plate part, a mounting surface part, a first recessed engagement part, and a second recessed engagement part, the mounting surface part being located between the first mounting plate part and the second mounting plate part and having a second screw-insertion hole, the first recessed engagement part and the second recessed engagement part being respectively provided to the first mounting plate part and the second mounting plate part, the first recessed engagement part and the second recessed engagement part being movable in a state where the first recessed engagement part and the second recessed engagement part are respectively engaged with the first protruding engagement part and the second protruding engagement part; and a decorative-panel mounting screw used to, when the decorative-panel mounting screw is inserted through the second screw-insertion hole and the first screw-insertion hole and fastened into a screw-fastening hole provided in the indoor-unit body, cause the first mounting plate part and the second mounting plate part to deform such that the mounting surface part is displaced toward the indoor-unit body, and cause the first recessed engagement part and the second recessed engagement part to move to be closer toward each other than before the decorative-panel mounting screw is fastened into the screw-fastening hole.

7. The decorative panel of claim 6, wherein the first mounting plate part and the second mounting plate part each have two bendable hinge parts.

8. The decorative panel of claim 6, wherein the first recessed engagement part and the second recessed engagement part each comprise an elongated hole, and wherein the first protruding engagement part and the second protruding engagement part each have a shape of a claw that catches in the elongated hole.

9. The decorative panel of claim 6, wherein the first protruding engagement part and the second protruding engagement part are identical in shape to each other.

10. An indoor unit comprising:

the indoor-unit body having the screw-fastening hole; and the decorative panel of claim 6, the decorative panel being mounted to the indoor-unit body by fastening the decorative-panel mounting screw into the screw-fastening hole.

* * * * *